US009833963B2

(12) United States Patent
Nadachi et al.

(10) Patent No.: US 9,833,963 B2
(45) Date of Patent: Dec. 5, 2017

(54) SHEET FOLDING DEVICE AND CARTON FORMER

(71) Applicant: MITSUBISHI HEAVY INDUSTRIES PRINTING & PACKAGING MACHINERY, LTD., Mihara-shi, Hiroshima (JP)

(72) Inventors: Mitsuhiro Nadachi, Mihara (JP); Osamu Hatano, Mihara (JP)

(73) Assignee: MITSUBISHI HEAVY INDUSTRIES PRINTING & PACKAGING MACHINERY, LTD., Hiroshima (JP)

( * ) Notice: Subject to any disclaimer, the term of this patent is extended or adjusted under 35 U.S.C. 154(b) by 668 days.

(21) Appl. No.: 14/377,256

(22) PCT Filed: Jan. 23, 2013

(86) PCT No.: PCT/JP2013/051315
§ 371 (c)(1),
(2) Date: Aug. 7, 2014

(87) PCT Pub. No.: WO2013/125285
PCT Pub. Date: Aug. 29, 2013

(65) Prior Publication Data

US 2015/0024917 A1 Jan. 22, 2015

(30) Foreign Application Priority Data

Feb. 20, 2012 (JP) ..... 2012-034562

(51) Int. Cl.
*B31B 1/36* (2006.01)
*B31B 1/00* (2006.01)

(52) U.S. Cl.
CPC ..... *B31B 1/36* (2013.01); *B31B 1/00* (2013.01); *B31B 2201/0247* (2013.01);
(Continued)

(58) Field of Classification Search
CPC .... B31B 1/00; B31B 1/26; B31B 1/36; B31B 1/58; B31B 2201/2637; B31B 2201/2683; B31B 2203/00; B31B 2203/003
(Continued)

(56) References Cited

U.S. PATENT DOCUMENTS 3,611,884 A * 10/1971 Hottendorf ..... B31B 1/00 493/270
4,254,692 A * 3/1981 Sardella ..... B31B 1/00 493/179
(Continued)

FOREIGN PATENT DOCUMENTS

CN 101239509 A 8/2008
CN 201346885 Y 11/2009
(Continued)

OTHER PUBLICATIONS

Decision to Grant a Patent dated Jun. 2, 2015, corresponding to Japanese patent application No. 2012-034562.
(Continued)

*Primary Examiner* — Hemant M Desai
*Assistant Examiner* — William A Weller
(74) *Attorney, Agent, or Firm* — Hauptman Ham, LLP

(57) ABSTRACT

A folder/gluer unit includes an upper transfer belt that transfers a corrugated sheet in a direction of transfer, a pair of forming belts that abut against a folding surface which is formed by folding both end portions of the corrugated sheet in a width direction orthogonal to the direction of transfer and fold both of the end portions of the corrugated sheet in the width direction, a pair of folding bars that are disposed in the direction of transfer, abut against the folding surface at both of the end portions of the folded corrugated sheet in the width direction, and guide both of the end portions of the corrugated sheet in the width direction, a moving mecha-
(Continued)

nism that moves the pair of folding bars in the width direction and in a vertical direction, and a control unit that controls the moving mechanism to adjust a position of the folding bar.

20 Claims, 9 Drawing Sheets

(52) U.S. Cl.
CPC ... *B31B 2201/26* (2013.01); *B31B 2201/2637* (2013.01); *B31B 2201/2683* (2013.01); *B31B 2203/003* (2013.01); *B31B 2203/066* (2013.01); *B31B 2203/082* (2013.01)

(58) Field of Classification Search
USPC ..... 493/51, 52, 53, 56, 64, 69, 71, 72, 73, 493/79, 80, 81, 162, 178, 179, 183, 340, 493/352, 356, 357, 358, 359, 395, 397, 493/398, 399, 405, 423, 436, 68, 70, 429, 493/441
See application file for complete search history.

(56) References Cited

U.S. PATENT DOCUMENTS 4,295,841 A * 10/1981 Ward, Jr. ..... B31B 1/00 493/179
5,716,314 A * 2/1998 Lauderbaugh ..... B31F 1/0019 493/439
5,827,162 A * 10/1998 Rubin ..... B31B 1/00 493/178
6,616,585 B2 * 9/2003 Okamoto ..... B31B 1/00 493/125
8,033,975 B2 * 10/2011 Wiklund ..... B31B 1/00 493/182

FOREIGN PATENT DOCUMENTS

| | | | |
|---|---|---|---|
| CN | 101873926 | A | 10/2010 |
| FR | 2262593 | A1 | 9/1975 |
| JP | 50-122320 | A | 9/1975 |
| JP | 56-63437 | A | 5/1981 |
| JP | 6-1403 | Y2 | 1/1994 |
| JP | 2011-098543 | A | 5/2011 |
| WO | 2009/050272 | A1 | 4/2009 |

OTHER PUBLICATIONS

International Search Report dated Mar. 12, 2013, in corresponding International Application No. PCT/JP2013/051315.
Written opinion of the International Searching Authority dated Mar. 12, 2013, in corresponding International Application No. PCT/JP2013/051315.
Notice of Allowance in KR Application No. 10-2014-7021726, dated Jun. 21, 2016.
Office Action dated Feb. 3, 2015, corresponding to Japanese patent application No. 2012-034562.
Notice of Allowance in CN Application No. 201380008532.3 dated Jan. 7, 2016.
Office Action dated Sep. 14, 2015, corresponding to Chinese Patent Application No. 201380008532.2.
Extended European Search Report dated Sep. 22, 2015, corresponding to European Patent Application No. 13751622.5.

* cited by examiner

SHEET FOLDING DEVICE AND CARTON FORMER

RELATED APPLICATIONS

The present application is a National Phase of International Application Number PCT/JP2013/051315 filed Jan. 23, 2013, and claims priority of Japanese Application Number 2012-034562 filed Feb. 20, 2012.

TECHNICAL FIELD

The present invention relates to a sheet folding device that folds a transfer sheet such as a corrugated sheet, and a carton former.

BACKGROUND ART

In the related art, PTL 1 discloses a corrugated sheet folding device as a sheet folding device that folds a corrugated sheet. The folding device includes a folding belt and a folding bar. The folding belt folds both end portions of the corrugated sheet in a width direction. The folding bar assists in the folding operation by the folding belt. The folding device can fold a plurality of types of the corrugated sheets that differ in shape, size, and the like, and an additional folding bar is mounted when corrugated sheets of special specifications are folded. In this manner, the folding device can also fold the corrugated sheets of special specifications appropriately.

CITATION LIST

Patent Literature

[PTL 1] Japanese Unexamined Patent Application Publication No. 2011-98543

SUMMARY OF INVENTION

Technical Problem

However, an additional folding bar has to be mounted in a case where the corrugated sheets of special specifications (for example, specifications where a folding surface that is formed by folding both of the end portions of the corrugated sheet in the width direction is extremely long in the width direction) are folded with the folding device of the related art. Accordingly, an operation for mounting the additional folding bar on the folding device has to be performed, after stopping the operation of the folding device, in the case of a change from another corrugated sheet to the corrugated sheet of special specifications, and this results in an extended operation time caused by the mounting of the additional folding bar. In addition, in a case where a position of the additional folding bar has to be finely adjusted between the mounting of the additional folding bar and a stable folding of the corrugated sheet, the operation of the folding device has to be stopped and the position of the additional folding bar has to be finely adjusted before a re-operation of the folding device so as to check whether the corrugated sheet after the fine adjustment is folded stably or not, and this also results in an extended operation time caused by the adjustment of the position of the additional folding bar. Further, the adjustment of the position of the folding bar has to be performed prior to the initiation of the operation even for the corrugated sheet of normal specifications that do not require the mounting of the additional folding bar. In a case where the corrugated sheet is not folded appropriately, the operation of the folding device has to be stopped and the position of the folding bar has to be adjusted as described above. As such, the operation time is extended for the folding devices of the related art due to the corrugated sheet change, which makes it difficult to improve operation efficiency.

An object of the present invention is to provide a sheet folding device and a carton former that are capable of improving operation efficiency by shortening an operation time caused by a transfer sheet change.

Solution to Problem

According to an aspect of the present invention, there is provided a sheet folding device including a transfer belt that transfers a transfer sheet in a direction of transfer, a forming belt that abuts against a folding surface which is formed by folding both end portions of the transfer sheet in a width direction orthogonal to the direction of transfer and folds both of the end portions of the transfer sheet in the width direction, a folding bar that is disposed in the direction of transfer, abuts against the folding surface at both of the end portions of the folded transfer sheet in the width direction, and guides both of the end portions of the transfer sheet in the width direction, a moving mechanism that moves the folding bar in the width direction and in a vertical direction, and a control unit that controls the moving mechanism to adjust a position of the folding bar.

According to this configuration, the moving mechanism is controlled by the control unit, and thus the position of the folding bar can be adjusted automatically. Accordingly, a mounting operation for mounting the folding bar is not required, and an operation time can be shortened. In addition, the operation does not have to be stopped even in a case where the position of the folding bar is finely adjusted. In other words, the position of the folding bar can be finely adjusted while the folding of the transfer sheet is checked, without having to stop the operation of the device, even in a case where the position of the folding bar has to be finely adjusted. As such, the operation time can be shortened.

In this case, it is preferable that the moving mechanism have an inlet side support mechanism that supports an inlet side of the folding bar in the direction of transfer, a outlet side support mechanism that supports a outlet side of the folding bar in the direction of transfer, and a central gripping moving mechanism that grips the folding bar between the inlet side support mechanism and the outlet side support mechanism to move the folding bar in the width direction and in the vertical direction.

According to this configuration, a center of the folding bar in the direction of transfer is moved in the width direction and in the vertical direction in a state where both end sides of the folding bar in the direction of transfer are supported, and thus the position of the folding bar can be adjusted. The position of the folding bar can be adjusted when the central gripping moving mechanism is disposed at the center of the folding bar in the direction of transfer, and the configuration can be simplified.

In this case, it is preferable that the inlet side support mechanism have a plurality of pivoting mechanisms, and support an inlet side end portion of the folding bar to be pivotable by the plurality of pivoting mechanisms.

According to this configuration, the inlet side end portion of the folding bar can be pivotable in response to a movement of a central portion of the folding bar by the central gripping moving mechanism. Accordingly, followability can be improved.

In this case, it is preferable that the plurality of pivoting mechanisms have a first pivoting mechanism that supports the inlet side end portion of the folding bar to be pivotable in a predetermined plane.

According to this configuration, the inlet side end portion of the folding bar can be pivotable in the predetermined plane by the first pivoting mechanism.

In this case, it is preferable that the plurality of pivoting mechanisms have a second pivoting mechanism that supports the inlet side end portion of the folding bar to be pivotable in an orthogonal plane which is orthogonal into the predetermined plane.

According to this configuration, the inlet side end portion of the folding bar can be pivotable in the orthogonal plane by the second pivoting mechanism.

In this case, it is preferable that the inlet side support mechanism have a gripping member that grips the inlet side end portion of the folding bar, the first pivoting mechanism that pivotably supports the gripping member, a pivot shaft where the first pivoting mechanism is disposed, the second pivoting mechanism that pivotably supports the pivot shaft, and a supporting shaft that is mounted on a device frame where the second pivoting mechanism is disposed.

According to this configuration, the gripping member that grips the inlet side end portion of the folding bar in the direction of transfer can be allowed to pivot in, for example, the horizontal plane and the vertical plane in response to the movement of the central portion of the folding bar by the central gripping moving mechanism. Accordingly, the inlet side end portion of the folding bar in the direction of transfer can be allowed to appropriately follow the movement of the central portion of the folding bar.

In this case, it is preferable that the first pivoting mechanism be a pair of first collars that are mounted on the pivot shaft, and the gripping member be disposed between the pair of first collars, and be axially supported to be pivotable by the pivot shaft in a state where a position of the gripping member is regulated in an axial direction of the pivot shaft by the pair of first collars.

According to this configuration, the first pivoting mechanism can be configured by using the pair of first collars, and thus can be simple and inexpensive.

In this case, it is preferable that the second pivoting mechanism be a pair of second collars that are mounted on the supporting shaft, and the pivot shaft be disposed between the pair of second collars, and be axially supported to be pivotable by the supporting shaft in a state where a position of the pivot shaft is regulated in the axial direction of the supporting shaft by the pair of second collars.

According to this configuration, the second pivoting mechanism can be configured by using the pair of second collars, and thus can be simple and inexpensive.

In this case, it is preferable that the central gripping moving mechanism have a plurality of pivoting mechanisms and support a central portion of the folding bar to be pivotable by the plurality of pivoting mechanisms.

According to this configuration, the central portion of the folding bar can be pivotable in response to the movement of the central portion of the folding bar by the central gripping moving mechanism. Accordingly, the followability can be improved.

In this case, it is preferable that the plurality of pivoting mechanisms have a third pivoting mechanism that supports the central portion of the folding bar to be pivotable in a predetermined plane.

According to this configuration, the central portion of the folding bar can be pivotable in the predetermined plane by the third pivoting mechanism.

In this case, it is preferable that the plurality of pivoting mechanisms have a fourth pivoting mechanism that supports the central portion of the folding bar to be pivotable in the orthogonal plane which is orthogonal into the predetermined plane.

According to this configuration, the central portion of the folding bar can be pivotable in the predetermined plane by the fourth pivoting mechanism.

In this case, it is preferable that the central gripping moving mechanism have a gripping portion that is disposed in the folding bar, a connection member that is connected to the gripping portion, a third pivoting mechanism that pivotably supports the connection member, a first pivoting member where the third pivoting mechanism is disposed, a fourth pivoting mechanism that pivotably supports the first pivoting member, a second pivoting member where the fourth pivoting mechanism is disposed, a vertical direction moving mechanism that moves the second pivoting member in the vertical direction, and a width direction moving mechanism that moves the vertical direction moving mechanism in the width direction.

According to this configuration, the gripping portion that grips the central portion of the folding bar and the connection member can be allowed to pivot in, for example, the horizontal plane and the vertical plane in response to the movement of the central portion of the folding bar by the vertical direction moving mechanism and the width direction moving mechanism. Accordingly, the central portion of the folding bar can be allowed to appropriately follow the movement by the vertical direction moving mechanism and the width direction moving mechanism.

In this case, it is preferable that a plurality of the gripping portions be disposed in the axial direction of the folding bar, and the connection member connect the plurality of gripping portions.

According to this configuration, the plurality of gripping portions can grip the folding bar at a plurality of points. Accordingly, the plurality of gripping portions can allow the folding bar to be more smoothly curved, during the movement of the folding bar, than in a case where the folding bar is gripped at a single point, and thus the folding surface of the transfer sheet can be guided appropriately.

In this case, it is preferable that the gripping portion have a pair of claw portions that pinch the folding bar from both outer sides in a radial direction, one of the pair of claw portions be disposed on an inner side in the width direction and the other one of the pair of claw portions is disposed on an outer side in the width direction, and a length of the one claw portion on the inner side in the width direction be shorter than a length of the other claw portion on the outer side in the width direction.

According to this configuration, the one claw portion on the inner side in the width direction is shorter, and thus the inner side of the folding bar in the width direction, which is likely to be interfered with by the transfer sheet, can be exposed. Accordingly, the transfer sheet is unlikely to interfere with the folding bar, and the folding bar can allow the transfer sheet to abut and be guided appropriately.

In this case, it is preferable that the vertical direction moving mechanism have a pair of upper and lower limit switches that are disposed in the vertical direction, and the control unit detect an original point of the folding bar in the vertical direction based on a detection result of each of the limit switches.

According to this configuration, the original point of the folding bar in the vertical direction can be detected, and thus a movement control can be performed precisely by performing the movement control in the vertical direction on the folding bar based on the original point.

In this case, it is preferable that the vertical direction moving mechanism further have a motor as a driving source that moves the folding bar in the vertical direction, and a rotary encoder that detects an amount of rotation of the motor, and the control unit derive an amount of movement in the vertical direction from the amount of rotation that is detected by the rotary encoder, and acquire a position of the folding bar in the vertical direction.

According to this configuration, the amount of movement of the folding bar in the vertical direction can be grasped accurately, and thus the movement control of the folding bar in the vertical direction can be performed with even higher precision.

In this case, it is preferable that a pair of the folding bars be disposed, the width direction moving mechanism have three limit switches that are disposed in the width direction, and the control unit detect an original point of each of the pair of folding bars in the width direction based on a detection result of each of the limit switches.

According to this configuration, the respective original points of the pair of folding bars in the width direction can be detected, and thus the movement control can be performed precisely by performing the movement control, in the width direction on the folding bars based on the original points.

In this case, it is preferable that a pair of the vertical direction moving mechanisms be disposed to correspond to the pair of folding bars, the central gripping moving mechanism further have a pair of connection arms that connect the pair of vertical direction moving mechanisms to the width direction moving mechanism, and a pair of the three limit switches be disposed on both outer sides of the pair of connection arms in the width direction and one of the one limit switches be mounted on an inner side of one of the connection arms.

According to this configuration, the original points of the pair of folding bars in the width direction can be detected with the three limit switches, without a pair of limit switches being disposed with respect to the respective folding bars, and thus the configuration can be simplified.

In this case, it is preferable that the width direction moving mechanism further have a pair of motors as a driving source that move the pair of folding bars in the width direction, and a pair of rotary encoders that detect amounts of rotation of the respective motors, and the control unit derive an amount of movement in the width direction from the amounts of rotation that are detected by the pair of rotary encoders, and acquire respective positions of the pair of folding bars in the width direction.

According to this configuration, the amounts of movement of the pair of folding bars in the width direction can be grasped accurately, and thus the movement control of the pair of folding bars in the width direction can be performed with even higher precision.

In this case, it is preferable that the outlet side support mechanism have a gripping claw that grips an outlet side end portion of the folding bar, and the gripping claw expose and grip an upper side of the folding bar in the vertical direction.

According to this configuration, the gripping claw can expose the upper side of the outlet side end portion of the folding bar in the vertical direction. Accordingly, the transfer sheet that passes above the folding bar on the outlet side in the direction of transfer is unlikely to interfere with the folding bar, and the folding bar can allow the transfer sheet to abut and be guided appropriately.

In this case, it is preferable that the inlet side support mechanism and the outlet side support mechanism support the folding bar to be movable in the axial direction, and the central gripping moving mechanism grip the folding bar by regulating a movement of the folding bar in the axial direction.

According to this configuration, the inlet side end portion and the outlet side end portion of the folding bar in the direction of transfer can be moved in the axial direction in response to the movement of the center of the folding bar by the central gripping moving mechanism. Accordingly, the inlet side end portion and the outlet side end portion of the folding bar in the direction of transfer can be allowed to appropriately follow the movement of the center of the folding bar in the axial direction.

According to another aspect of the present invention, there is provided a carton former including a paper feed unit that supplies a transfer sheet, a printing unit that performs printing on the transfer sheet, a paper discharge unit that performs ruled line processing and grooving on a front surface of the transfer sheet, the sheet folding device that forms a box by folding both of the end portions of the transfer sheet in the width direction and bonding both of the end portions of the transfer sheet in the width direction, and a counter ejector portion that discharges a predetermined number of the boxes after stacking the boxes while counting the boxes.

According to this configuration, the sheet folding device can automatically adjust a position of a folding bar, and thus can shorten an operation time caused by a transfer sheet change, even in a case where the transfer sheets are changed in type. In this manner, a plurality of types of transfer sheets can be folded to form a plurality of types of boxes with high efficiency.

Advantageous Effects of Invention

According to the sheet folding device and the carton former of the present invention, operation efficiency can be improved by shortening the operation time caused by the transfer sheet change.

DESCRIPTION OF EMBODIMENTS

Hereinafter, a sheet folding device and a carton former according to the present invention will be described with reference to the accompanying drawings. The present invention is not limited to the following embodiment. Components of the following embodiment include those that can be easily replaced by those skilled in the art or those substantially the same as the components.

Embodiment

Figure 1:
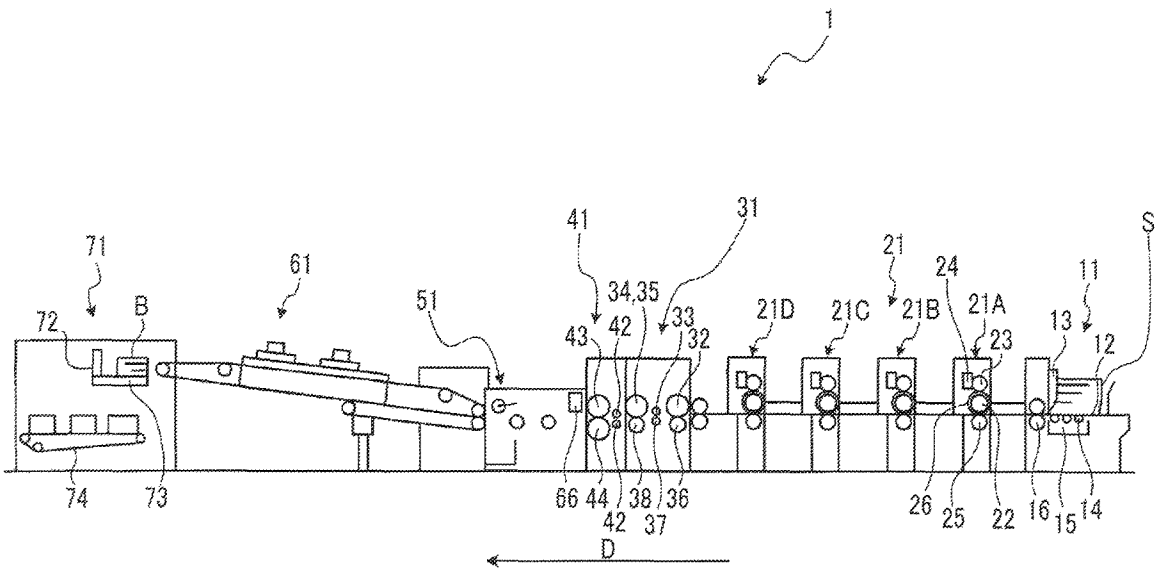
FIG. 1 is a schematic configuration diagram of a carton former that includes a folder/gluer unit according to this embodiment.

FIG. 1 is a schematic configuration diagram of the carton former that includes a folder/gluer unit according to this embodiment. As illustrated in FIG. 1, a carton former 1 is used to manufacture a corrugated cardboard box (box) B by processing a corrugated sheet (transfer sheet) S. The carton former 1, where the corrugated sheet S and the corrugated cardboard box B are linearly arranged in a direction D of transfer, is configured to include a paper feed unit 11, a printing unit 21, a paper discharge unit 31, a die cut unit 41, a defective product removing unit 51, a folder/gluer unit (sheet folding device) 61, and a counter ejector portion 71.

The paper feed unit 11 sends out the corrugated sheets S sheet by sheet to feed the corrugated sheets S to the printing unit 21 at a constant speed. The paper feed unit 11 has a table 12, a front stop 13, supply rollers 14, a suction device 15, and a feed roll 16. The multiple corrugated sheets S can be stacked and placed on the table 12, and the table 12 is supported to be capable of being lifted and lowered. The front stop 13 can determine front end positions of the corrugated sheets S that are stacked on the table 12, and a gap is ensured between a lower end portion thereof and the table 12 such that one of the corrugated sheets S can pass therethrough. The plurality of supply rollers 14 are arranged in the direction D of transfer of the corrugated sheets S to correspond to the table 12. When the table 12 is lowered, the supply roller 14 can send out the corrugated sheet S that is at the lowest position, among the multiple stacked corrugated sheets S, forward. The suction device 15 suctions the stacked corrugated sheets S downward, that is, to the table 12 and the supply roller 14 sides. The feed roll 16 can supply the corrugated sheet S that is sent out by the supply roller 14 to the printing unit 21.

The printing unit 21 performs multi-color printing (four-color printing in this embodiment) on a front surface of the corrugated sheet S. In the printing unit 21, four printings units 21A, 21B, 21C, and 21D are serially arranged in the direction D of transfer to be capable of performing the printing on the front surface of the corrugated sheet S by using four ink colors. The printing units 21A, 21B, 21C, and 21D have substantially the same configuration, and each of the printing units 21A, 21B, 21C, and 21D has a printing cylinder 22, an ink supply roll 23, an ink chamber 24, and a receiving roll 25. The printing cylinder 22 has a printing plate 26 mounted on an outer circumferential portion thereof, and is rotatably disposed. The ink supply roll 23 is arranged to be in contact with the printing plate 26 in pairs in the vicinity of the printing cylinder 22, and is rotatably disposed. The ink chamber 24 stores ink, and is disposed in the vicinity of the ink supply roll 23. The receiving roll 25 pinches the corrugated sheet S between the printing cylinder 22 and the receiving roll 25 to transfer the corrugated sheet S while applying a predetermined printing pressure thereto, and is rotatably disposed below the printing cylinder 22 to face the printing cylinder 22. Each of the printing units 21A, 21B, 21C, and 21D has a pair of upper and lower feed rolls (not illustrated) disposed in front and behind.

The paper discharge unit 31 performs ruled line processing and grooving on the corrugated sheet S. The paper discharge unit 31 has a first ruled line roll 36, a second ruled line roll 37, a slitter knife 34, and a slotter knife 35. The first ruled line roll 36 is formed to have a circular shape, and a plurality (four in this embodiment) of the first ruled line rolls 36 are arranged at predetermined intervals in a horizontal direction that is orthogonal to the direction D of transfer of the corrugated sheet S. The first ruled line roll 36 can be rotated by a driving device (not illustrated). The second ruled line roll 37 is formed to have a circular shape, and a plurality (four in this embodiment) of the second ruled line rolls 37 are arranged at predetermined intervals in the horizontal direction that is orthogonal to the direction D of transfer of the corrugated sheet S. The second ruled line roll 37 can be rotated by the driving device (not illustrated). In this case, the first ruled line roll 36 performs the ruled line processing on a back surface (lower surface) of the corrugated sheet S, and the second ruled line roll 37 performs the ruled line processing on the back surface (lower surface) of the corrugated sheet S as is the case with the first ruled line roll 36. Receiving rolls 32 and 33 are disposed to be rotatable in synchronization at upper positions that face the respective ruled line rolls 36 and 37.

The slitter knife 34 and the slotter knife 35 are formed to have a circular shape, and a plurality (five in this embodiment) of the slitter knives 34 and the slotter knives 35 are arranged at predetermined intervals in the horizontal direction that is orthogonal to the direction D of transfer of the corrugated sheet S. The slitter knife 34 and the slotter knife 35 can be rotated by the driving device (not illustrated). The number of the slitter knife 34 is one, and the slitter knife 34 is disposed to correspond to an end portion of the transferred corrugated sheet S in a width direction to be capable of cutting the end portion of the corrugated sheet S in the width direction. The number of the slotter knives 35 is four, and the slotter knives 35 are disposed to correspond to predetermined positions of the transferred corrugated sheet S in the width direction to be capable of performing the grooving on the predetermined positions of the corrugated sheet S. In this case, a receiving roll 38 is disposed to be rotatable in synchronization at a lower position facing the slitter knife 34 and the slotter knives 35.

The die cut unit 41 performs hand hole drilling or punching into a special shape on the corrugated sheet S. The die cut unit 41 has a pair of upper and lower feed pieces 42, an anvil cylinder 43, and a knife cylinder 44. The feed piece 42 pinches the corrugated sheet S from above and below and transfers the corrugated sheet S, and is rotatably disposed. Each of the anvil cylinder 43 and the knife cylinder 44 is formed to have a circular shape, and can be rotated in synchronization by the driving device (not illustrated). In this case, the anvil cylinder 43 has an anvil formed in an outer circumferential portion, and the knife cylinder 44 has a knife and a die formed at predetermined positions in an outer circumferential portion.

When the corrugated sheet S is a defective product, the defective product removing unit 51 removes the corrugated sheet S (corrugated cardboard box B), which is supplied from the paper feed unit 11, subjected to the printing by the printing unit 21, subjected to the ruled line processing and the grooving by the paper discharge unit 31, and subjected to the drilling by the die cut unit 41, from a production line. In addition, a gluing device is disposed between the die cut unit 41 and the defective product removing unit 51. The gluing device has a glue gun, and can perform gluing on a predetermined position of the corrugated sheet S by discharging a glue at a predetermined timing.

The folder/gluer unit 61 folds the corrugated sheet S while moving the corrugated sheet S in the direction D of transfer, and forms the flat corrugated cardboard box B by bonding both of the end portions in the width direction that is orthogonal to the direction D of transfer. An operation of the folder/gluer unit 61 can be controlled by a control device 100 (described in detail later).

The counter ejector portion 71 stacks the corrugated cardboard boxes B while counting the corrugated cardboard boxes B, then sorts the corrugated cardboard boxes B in a predetermined batch number, and then discharges the corrugated cardboard boxes B. The counter ejector portion 71 has a hopper device 72. The hopper device 72 has an elevator 73 that can be lifted and lowered, on which the corrugated cardboard box B is stacked, and a front contact plate and an angle adjusting plate (not illustrated) as shaping means are disposed in the elevator 73. A discharge conveyor 74 is disposed below the hopper device 72.

Figure 9:
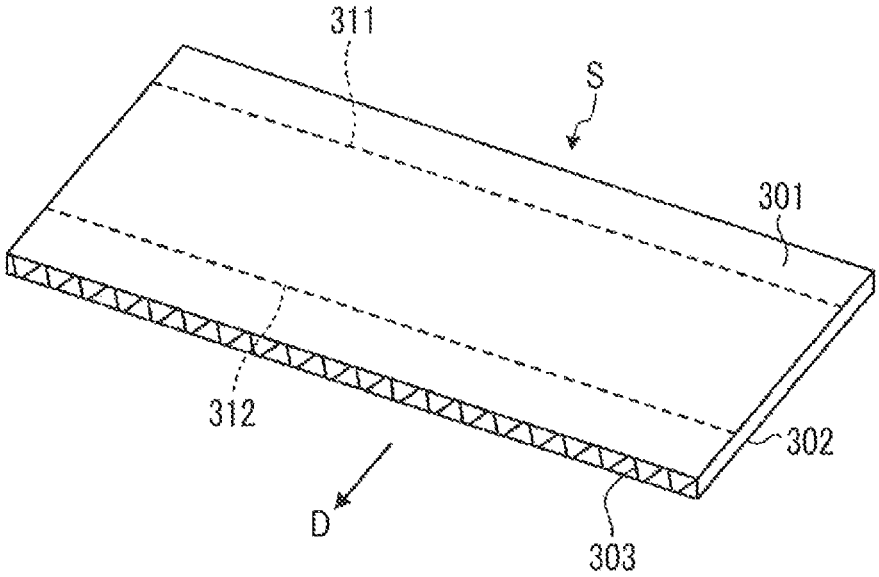
FIG. 9 is a perspective diagram of a corrugated sheet prior to processing.
Figure 10:
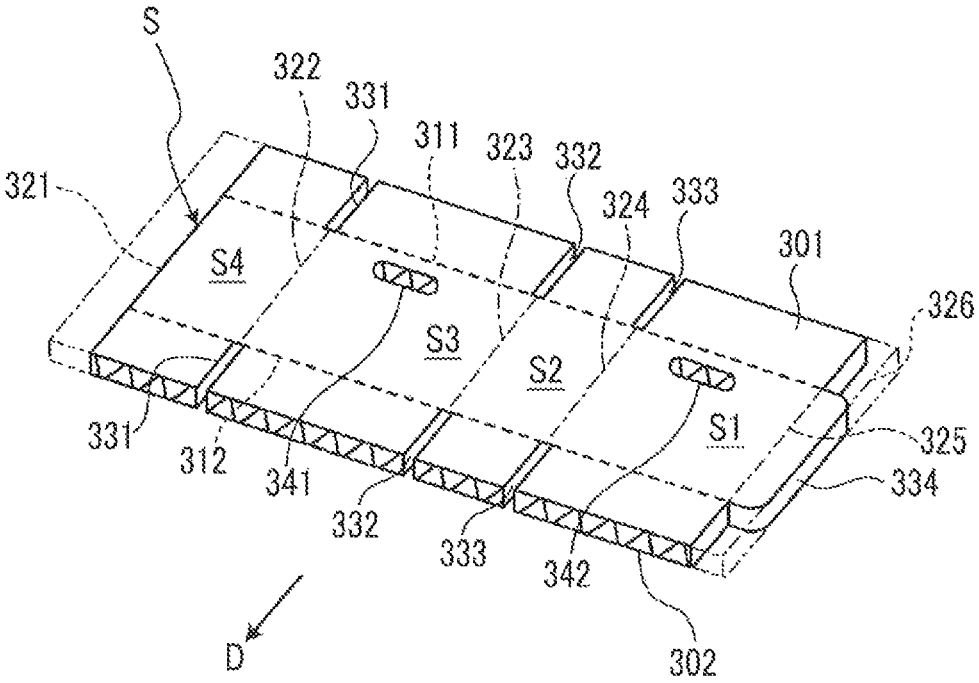
FIG. 10 is a perspective diagram of the corrugated sheet after ruled line processing and grooving.
Figure 11:
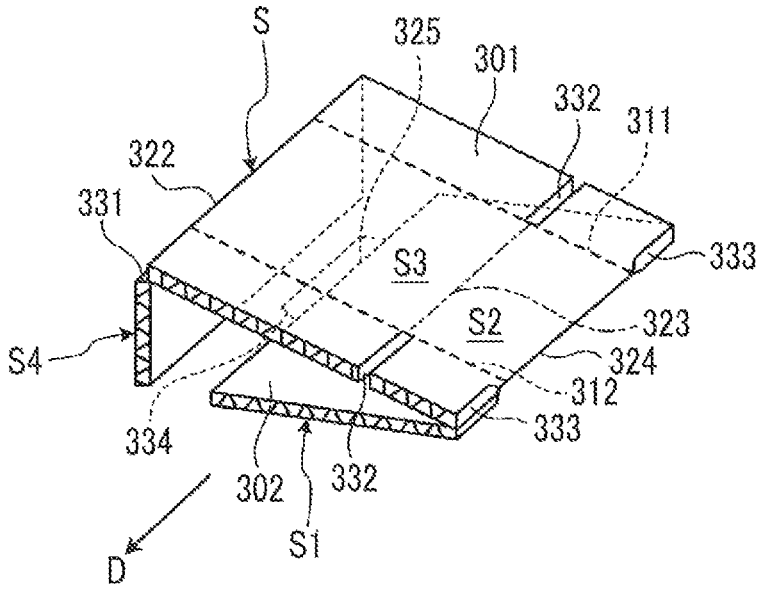
FIG. 11 is a perspective diagram of the corrugated sheet showing a state where folding is underway.
Figure 12:
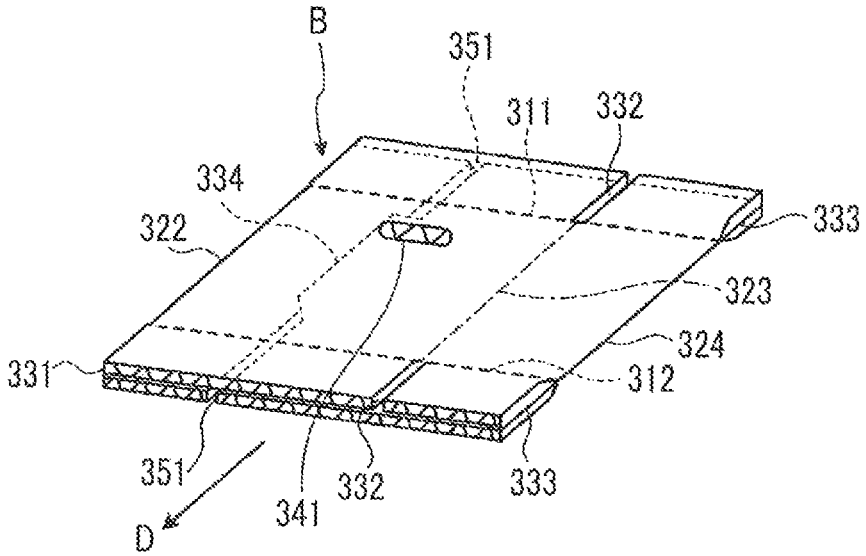
FIG. 12 is a perspective diagram of a corrugated cardboard box that is folded and bonded.

Herein, an operation of the carton former 1 for manufacturing the corrugated cardboard box B from the corrugated sheet S will be described with reference to FIGS. 1, and 9 to 12. FIG. 9 is a perspective diagram of the corrugated sheet prior to the processing. FIG. 10 is a perspective diagram of the corrugated sheet after the ruled line processing and the grooving. FIG. 11 is a perspective diagram of the corrugated sheet showing a state where folding is underway. FIG. 12 is a perspective diagram of a corrugated cardboard box that is folded and bonded.

As illustrated in FIG. 9, the corrugated sheet S is formed by the carton former 1 with a waveform corrugating medium 303 glued between a front liner 301 and a back liner 302. Two bend lines 311 and 312 are formed on the corrugated sheet S through a preceding process of the carton former 1. The bend lines 311 and 312 are to fold a flap when the corrugated cardboard box B, which is manufactured by the carton former 1, is assembled later. The corrugated sheet S described above is stacked on the table 12 of the paper feed unit 11 as illustrated in FIG. 1.

The multiple corrugated sheets S that are stacked on the table 12 of the paper feed unit 11 are positioned by the front stop 13 first, and then the corrugated sheet S that is at the lowest position is sent out by the plurality of supply rollers 14 as the table 12 is lowered. Then, the corrugated sheet S is supplied to the printing unit 21 on a predetermined certain side by a pair of the feed rolls 16.

In each of the printing units 21A, 21B, 21C, and 21D of the printing unit 21, the ink from the ink chamber 24 is supplied to a front surface of the ink supply roll 23. When the printing cylinder 22 and the ink supply roll 23 rotate, the ink on the front surface of the ink supply roll 23 is transferred to the printing plate 26. Then, when the corrugated sheet S is transferred to between the printing cylinder 22 and the receiving roll 25, the corrugated sheet S is pinched by the printing plate 26 and the receiving roll 25 and the printing is performed on the front surface as the printing pressure is applied to the corrugated sheet S. The corrugated sheet S, on which the printing is performed, is transferred to the paper discharge unit 31 by the feed roll.

When the corrugated sheet S passes through the first ruled line roll 36 first in the paper discharge unit 31, ruled lines 322, 323, 324, and 325 are formed on the back surface side of the corrugated sheet S, that is, on the back liner 302 side as illustrated in FIG. 10. In addition, when the corrugated sheet S passes through the second ruled line roll 37, the ruled lines 322, 323, 324, and 325 are formed again on the back surface side of the corrugated sheet S, that is, the back liner 302 side as is the case with the first ruled line roll 36. Then, when the corrugated sheet S, where the ruled lines 322, 323, 324, and 325 are formed, passes through the slitter knife 34, the end portion of the corrugated sheet S is cut at a cutting position 321. An end portion position 326 is not cut to remain in the corrugated sheet S. In addition, when the corrugated sheet S passes through the slotter knife 35, grooves 331, 332, and 333 and a margin piece 334 are formed at the positions of the ruled lines 322, 323, 324, and 325. The corrugated sheet S, where the grooves 331, 332, and 333 and the margin piece 334 are formed at the positions of the ruled lines 322, 323, 324, and 325, is transferred to the die cut unit 41.

In this manner, the corrugated sheet S is configured to have a first panel S1 between the ruled line 324 and the ruled line 325 that has the margin piece 334, a second panel S2 between the ruled line 323 and the ruled line 324, a third panel. S3 between the ruled line 322 and the ruled line 323, and a fourth panel S4 between the ruled line 322 and the cutting position 321.

Hand holes 341 and 342 are formed when the corrugated sheet S passes between the anvil cylinder 43 and the knife cylinder 44 in the die cut unit 41. The glue is applied to the margin piece 334 of the corrugated sheet S, where the hand holes 341 and 342 are formed, by the link piece 66 as illustrated in FIG. 1, and then the corrugated sheet S is transferred to the defective product removing unit 51.

In the defective product removing unit 51, defective product determination is performed on each place of the corrugated sheet S, which is supplied from the paper feed unit 11, subjected to the printing by the printing unit 21, subjected to the ruled line processing and the grooving by the paper discharge unit 31, and subjected to the drilling by the die cut unit 41. When the corrugated sheet S is a defective product, the corrugated sheet S that is the defective product is removed from the production line.

In the folder/gluer unit 61, the corrugated sheet S is folded downward from the ruled lines 322 and 324 as base points, as illustrated in FIG. 11, while being moved in the direction D of transfer. In other words, the first panel S1 and the fourth panel S4 of the corrugated sheet S are folded downward with respect to the second panel S2 and the third panel S3. A folding force becomes strong as the folding is in progress to close to 180 degrees, and the margin piece 334 and the end portion of the corrugated sheet S that is on top of the margin piece 334 are pressed to be in close contact with each other such that both of the end portions of the corrugated sheet S are bonded to result in the corrugated cardboard box B in a folded state as illustrated in FIG. 12. In this case, two gaps 351 are formed at the bonding place of the corrugated cardboard box B. Then, the corrugated cardboard box B is transferred to the counter ejector portion 71 as illustrated in FIG. 1.

The corrugated cardboard box B that is detected to be a non-defective product by the defective product removing unit 51 is fed to the hopper device 72 in the counter ejector portion 71. The corrugated cardboard box B that is fed to the hopper device 72 is stacked on the elevator 73 in a state where a tip end portion in the direction D of transfer abuts against the front contact plate and is shaped by the angle adjusting plate. Then, when a predetermined number of the corrugated cardboard boxes B are stacked on the elevator 73, the elevator 73 is lowered, and the predetermined number of the corrugated cardboard boxes B are discharged in one batch by the discharge conveyor 74 to be fed to a post stroke of the carton former 1.

Figure 2:
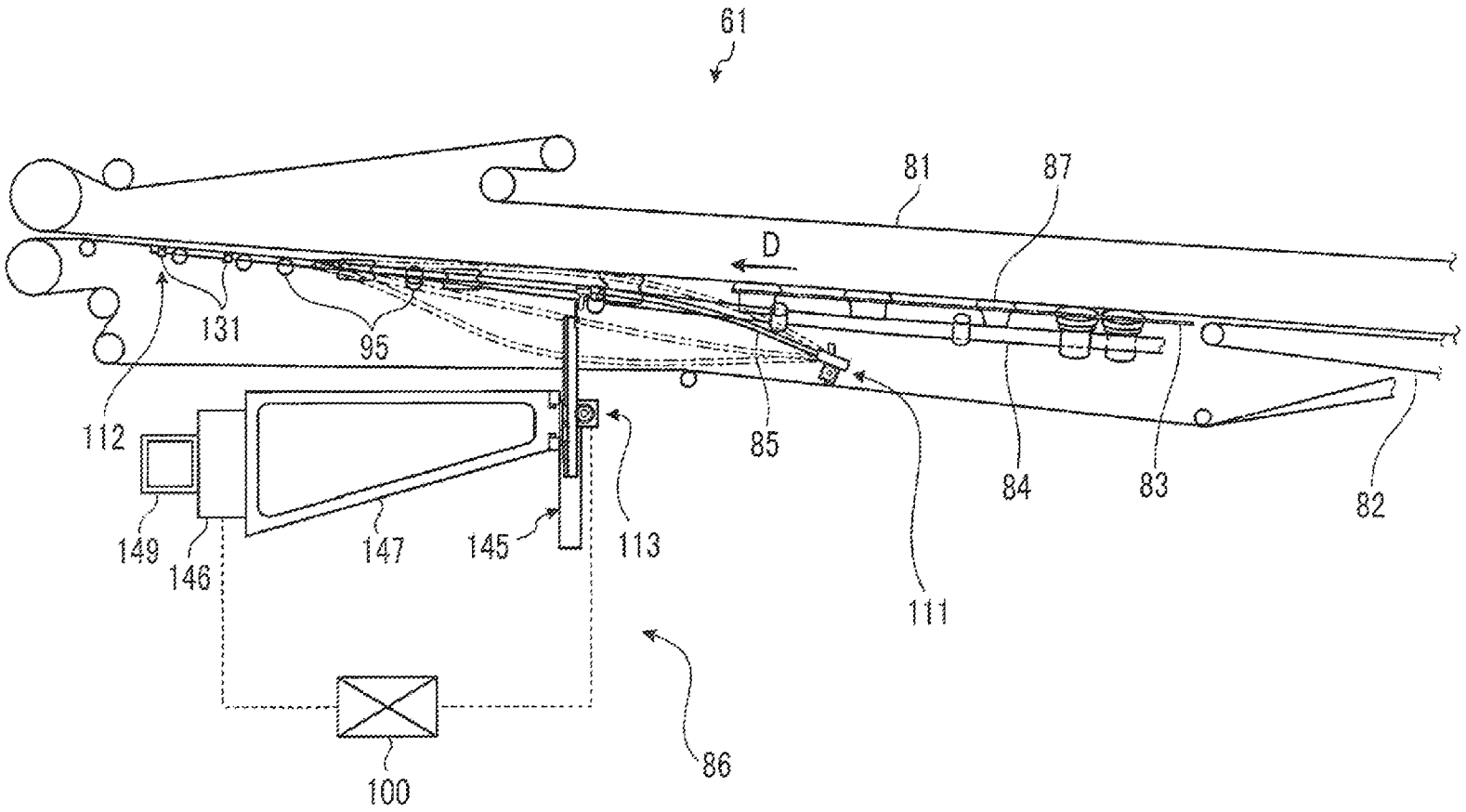
FIG. 2 is a schematic configuration diagram of the folder/gluer unit according to this embodiment.
Figure 3:
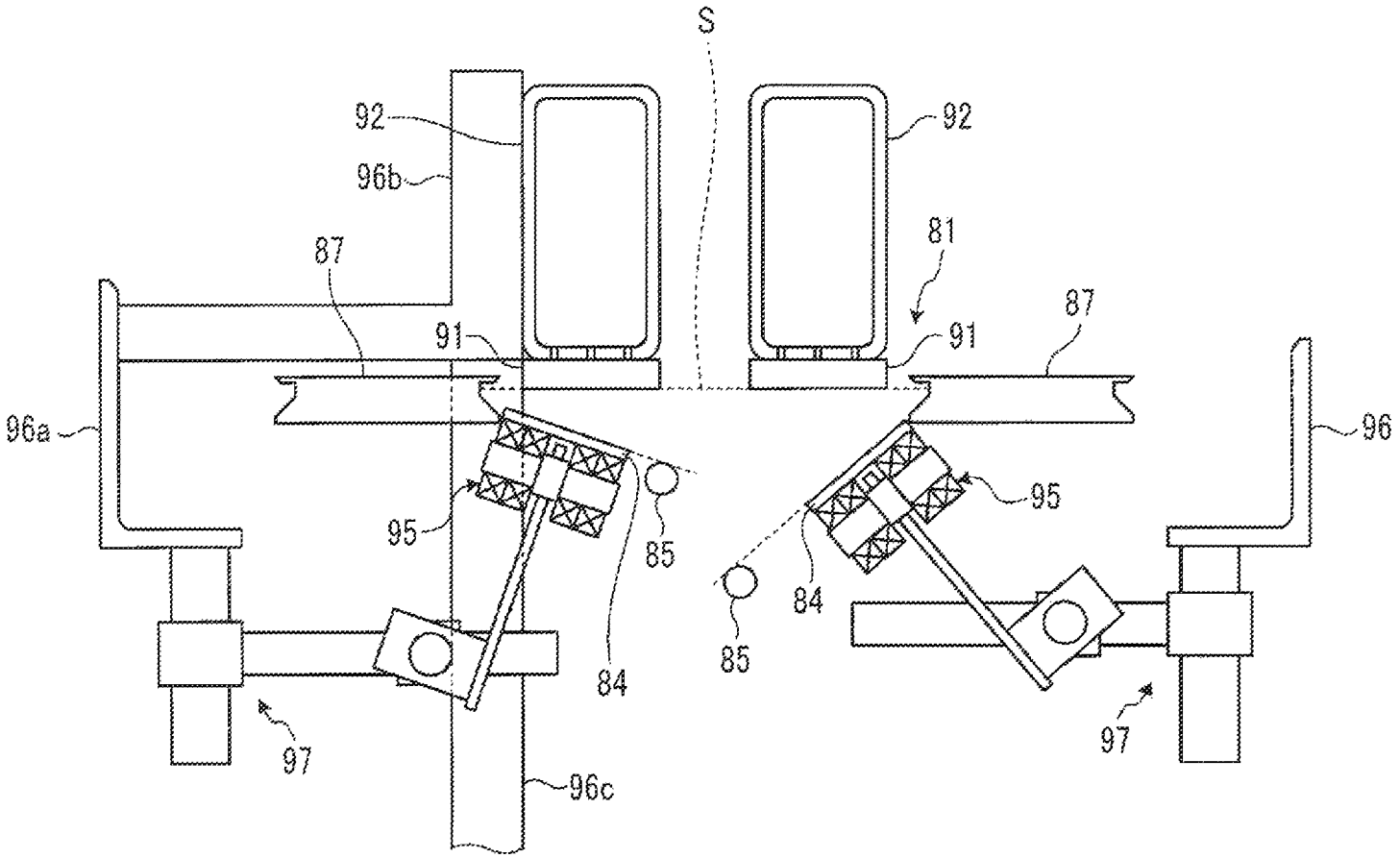
FIG. 3 is a cross-sectional diagram of the folder/gluer unit according to this embodiment that is cut in a plane which is orthogonal to a direction of transfer.

Next, the folder/gluer unit 61 of the carton former 1 described above will be described in detail with reference to FIGS. 2 and 3. FIG. 2 is a schematic configuration diagram of the folder/gluer unit according to this embodiment. FIG. 3 is a cross-sectional diagram of the folder/gluer unit according to this embodiment that is cut in a plane which is orthogonal to the direction of transfer. The folder/gluer unit 61 according to this embodiment forms the flat corrugated cardboard box B by folding the glued corrugated sheet S. The folder/gluer unit 61 has an upper transfer belt 81, a lower transfer belt 82, a pair of folding claws 83, a pair of forming belts 84, a pair of folding bars 85, a moving mechanism 86, and a plurality of gauge rollers 87, and the moving mechanism 86 is controlled by the control device (control unit) 100.

The upper transfer belt 81 is disposed on an upper side in a vertical direction, and is disposed over the entire length of the folder/gluer unit 61 in the direction D of transfer in FIG. 2, the upper transfer belt 81 is illustrated in a partially omitted state. The upper transfer belt 81 is an endless belt, and is configured to be orbitable with a plurality of pulleys wound therearound. A lower side of the orbiting upper transfer belt 81 moves toward the direction D of transfer, and an upper side of the upper transfer belt 81 moves toward a direction opposite to the direction D of transfer. The upper transfer belt 81 has a pair of adsorption belts 91, and a pair of ejector chambers 92 that are disposed above the respective adsorption belts 91 as illustrated in FIG. 3. The ejector chambers 92 adsorb an upper surface of the corrugated sheet S via the respective adsorption belts 91. In this manner, the corrugated sheet S is transferred in the direction D of transfer by the pair of adsorption belts 91 in a state where the corrugated sheet S is adsorbed by the pair of adsorption belts 91.

The lower transfer belt 82 is disposed on an inlet side of the upper transfer belt 81 in the direction of transfer and is disposed to face the upper transfer belt 81 as illustrated in FIG. 2. In FIG. 2, the lower transfer belt 82 is illustrated in a partially omitted state. The lower transfer belt 82 is an endless belt and is configured to be orbitable with a plurality of pulleys wound therearound as is the case with the upper transfer belt 81. An upper side of the orbiting lower transfer belt 82 moves toward the direction D of transfer, and a lower side of the lower transfer belt 82 moves toward the direction opposite to the direction D of transfer. Accordingly, on an inlet side of the folder/gluer unit 61 in the direction D of transfer, the corrugated sheet S that is supplied to the folder/gluer unit 61 is transferred from an inlet side of the direction D of transfer toward an outlet side while being pinched between the upper transfer belt 81 and the lower transfer belt 82.

The pair of folding claws 83 are disposed over the direction D of transfer on an outlet side of the lower transfer belt 82 in the direction D of transfer, and are disposed to face the upper transfer belt 81. The pair of folding claws 83 respectively abut against the ruled line 322 and the ruled line 324 on the lower surface of the corrugated sheet S that is transferred in the direction D of transfer. Accordingly, as for the pair of folding claws 83, in a case where both of the end portions of the corrugated sheet S in the width direction, that is, the first panel S1 and the fourth panel S4 of the corrugated sheet S are folded downward, the corrugated sheet S is transferred from the inlet side of the direction D of transfer toward the outlet side while being folded with the pair of folding claws 83, which abut against the ruled line 322 and the ruled line 324, acting as a guide.

The pair of forming belts 84 are disposed over the direction D of transfer on an outlet side of the lower transfer belt 82 in the direction D of transfer, and are disposed to abut against folding surfaces that are formed when both of the end portions of the corrugated sheet S in the width direction are folded, that is, the first panel S1 and the fourth panel S4. As illustrated in FIG. 3, one of the pair of forming belts 84 abuts against the first panel S1 of the corrugated sheet S, and the other one of the pair of forming belts 84 abuts against the fourth panel S4 of the corrugated sheet S. The respective forming belts 84 are endless belts and are configured to be orbitable with a plurality of pulleys 95 wound therearound as is the case with the upper transfer belt 81 and the lower transfer belt 82. Herein, each of the pulleys 95 is fixed to a device frame 96*a* of the folder/gluer unit 61 via a support member 97 as illustrated in FIG. 3. Each of the forming belts 84 is inclined at an inclination angle to fold the first panel S1 and the fourth panel S4 of the corrugated sheet S in the direction D of transfer while the pair of forming belts 84 abut against the first panel S1 and the fourth panel S4 on both sides of the corrugated sheet S in the width direction. A device frame 96*b* is integrally connected to the device frame 96*a*, and the device frame 96*b* supports the ejector chambers 92 and the gauge rollers 87 described above. In addition, a device frame 96*c* is integrally connected to the device frame 96*b*, and a limit switch 191 (described later) is mounted on the device frame 96*b*. The device frame 96*a*, the device frame 96*b*, and the device frame 96*c* are configured to be movable by a moving mechanism (not illustrated) in the width direction, and are appropriately moved according to the size of the manufactured corrugated cardboard box B. In FIG. 3, the device frame 96*b* and the device frame 96*c* are illustrated in one of the device frames 96*a*. However, the similar device frame 96*b* and the device frame 96*c* are also disposed in the other device frame 96*a*.

As illustrated in FIG. 3, the plurality of gauge rollers 87 are disposed on the outlet side of the lower transfer belt 82 in the direction D of transfer, and the plurality of gauge rollers 87 are disposed side by side in the direction D of transfer. The plurality of gauge rollers 87 are disposed on both end sides of the folded and transferred corrugated sheet S in the width direction, that is, on both end sides of the second panel S2 and the third panel S3 of the corrugated sheet S in the width direction. Accordingly, the plurality of gauge rollers 87 transfer the corrugated sheet S from the inlet side of the direction D of transfer toward the outlet side while gripping both of the end sides of the folded and transferred corrugated sheet S in the width direction, that is, while gripping a site between the first panel S1 and the second panel S2 and a site between the third panel S3 and the fourth panel S4.

The pair of folding bars 85 are disposed on the outlet side of the folder/gluer unit 61 in the direction D of transfer with a part thereof disposed to overlap with the pair of folding claws 83 in the direction D of transfer and the entire part thereof disposed to overlap with the pair of forming belts 84 in the direction D of transfer. The folding bars 85 are round tubes formed of hard plastic. The pair of folding bars 85 are disposed to abut the folding surfaces of the corrugated sheet S, that is, the first panel S1 and the fourth panel S4. In other words, one of the pair of folding bars 85 abuts against the first panel S1 of the corrugated sheet S, and the other one of the pair of folding bars 85 abuts against the fourth panel S4 of the corrugated sheet S. The pair of folding bars 85 abut against the first panel S1 and the fourth panel S4 on both of the sides of the corrugated sheet S in the width direction, and positions of the respective folding bars 85 are curved to fold the first panel S1 and the fourth panel S4 of the corrugated sheet S in the direction D of transfer.

As illustrated in FIG. 2, the moving mechanism 86 adjusts the positions of the pair of folding bars 85 by moving the pair of folding bars 85. The moving mechanism 86 has a pair of inlet side support mechanisms ill, a pair of outlet side support mechanisms 112, and a pair of central gripping moving mechanisms 113. Hereinafter, the inlet side support mechanism 111, the outlet side support mechanism 112, and the central gripping moving mechanism 113 that correspond to one of the folding bars 85 and are applied thereto will be described.

Figure 4:
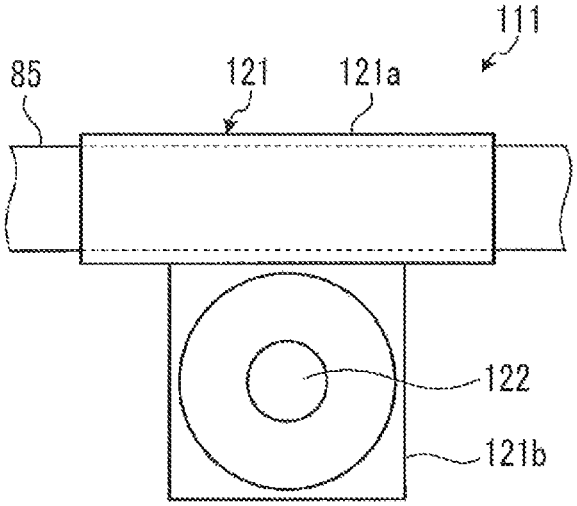
FIG. 4 is a schematic configuration diagram of an inlet side support mechanism.
Figure 5:
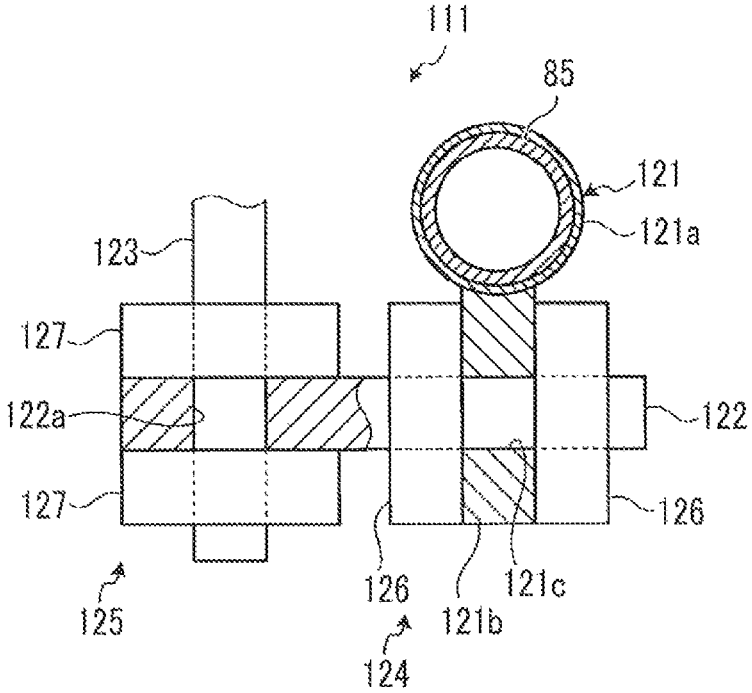
FIG. 5 is a partial cross-sectional diagram of the inlet side support mechanism that is cut in a plane which is orthogonal to an axial direction of a folding bar.

FIG. 4 is a schematic configuration diagram of the inlet side support mechanism, and FIG. 5 is a partial cross-sectional diagram of the inlet side support mechanism that is cut in a plane which is orthogonal to an axial direction of a folding bar. The inlet side support mechanism 111 supports an inlet side end portion of the folding bar 85 in the direction of transfer. As illustrated in FIGS. 4 and 5, the inlet side support mechanism 111 has a gripping member 121, a pivot shaft 122, and a supporting shaft 123. The gripping member 121 and the pivot shaft 122 are pivotably connected via a first pivoting mechanism 124, and the pivot shaft 122 and the supporting shaft 123 are pivotably connected via a second pivoting mechanism 125.

The gripping member 121 is configured to have a through pipe 121*a* into which the folding bar 85 is inserted, and a base portion 121*b* that is disposed to protrude in a radial direction of the through pipe 121*a*. The folding bar 85 is inserted in the axial direction into the through pipe 121*a* in a movable manner. A pivot hole 121*c*, into which the pivot shaft 122 is inserted, is formed in a penetrating manner in the base portion 121*b*.

One side (right side in FIG. 5) of the pivot shaft 122 in the axial direction is inserted into the pivot hole 121*c* of the gripping member 121, and the other side (left side in FIG. 5) of the pivot shaft 122 in the axial direction is pivotably disposed in the supporting shaft 123. The first pivoting mechanism 124 is disposed on the one side of the pivot shaft 122 in the axial direction. The first pivoting mechanism 124 is configured to have a pair of first collars 126. The pair of first collars 126 are mounted on the pivot shaft 122 at a predetermined interval. The gripping member 121 is disposed between the pair of first collars 126. In this manner, the gripping member 121 is axially supported to be pivotable in a predetermined plane (in a vertical plane) with a movement of the pivot shaft 122 in the axial direction regulated by the pair of first collars 126. A support hole 122*a*, into which the supporting shaft 123 is inserted, is formed in a penetrating manner on the other side of the pivot shaft 122.

One side (lower side in FIG. 5) of the supporting shaft 123 in the axial direction is inserted into the support hole 122*a* of the pivot shaft 122, and the other side (upper side in FIG. 5) of the supporting shaft 123 in the axial direction is fixed to a device frame (not illustrated). A second pivoting mechanism 125 is disposed on the one side of the supporting shaft 123 in the axial direction. The second pivoting mechanism 125 is configured to have a pair of second collars 127 as is the case with the first pivoting mechanism 124. The pair of second collars 127 are mounted on the supporting shaft 123 at a predetermined interval. The other side of the pivot shaft 122 is disposed between the pair of second collars 127. In this manner, the pivot shaft 122 is axially supported to be pivotable in a predetermined plane (in a horizontal plane) with a movement of the supporting shaft 123 in the axial direction regulated by the pair of second collars 127.

In the inlet side support mechanism 111, a pivoting plane (vertical plane) of the gripping member 121 that is allowed to pivot by the first pivoting mechanism 124 and a pivoting plane (horizontal plane) of the pivot shaft 122 that is allowed to pivot by the second pivoting mechanism 125 are orthogonal to each other. Accordingly, the inlet side end portion of the folding bar 85 that is supported by the inlet side support mechanism 111 is supported to be pivotable on the vertical plane and the horizontal plane.

Figure 6:
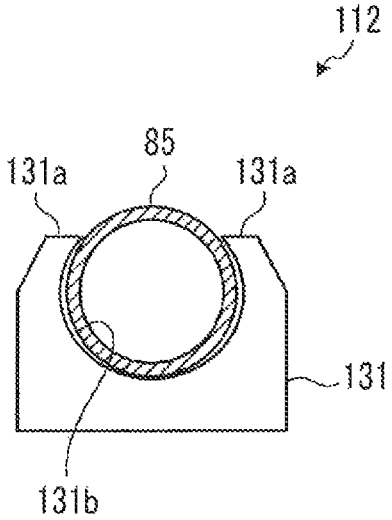
FIG. 6 is a schematic configuration diagram of an outlet side support mechanism.

FIG. 6 is a schematic configuration diagram of the outlet side support mechanism. The outlet side support mechanism 112 supports an outlet side end portion of the folding bar 85 in the direction of transfer. As illustrated in FIG. 2, the outlet side support mechanism 112 has a pair of gripping claws 131. The pair of gripping claws 131 are arranged at a predetermined interval in the axial direction of the folding bar 85, and hold the folding bar 85, which is gripped by the pair of gripping claws 131, in the same direction as the direction D of transfer of the corrugated sheet S.

As illustrated in FIG. 6, each of the gripping claws 131 exposes and grips an upper side of the folding bar 85 in the vertical direction. In other words, an upper portion of through-hole 131*b* of the gripping claw 131, into which the folding bar 85 is inserted, is open, and the opening width between a pair of claw portions 131*a* in an upper side end portion in the vertical direction is smaller than the diameter of the folding bar 85. The through-hole 131*b* allows the movement of the folding bar 85 in the axial direction. Accordingly, the gripping claws 131 regulate a deviation of the folding bar 85 in the radial direction and allow the movement of the folding bar 85 in the axial direction.

Figure 7:
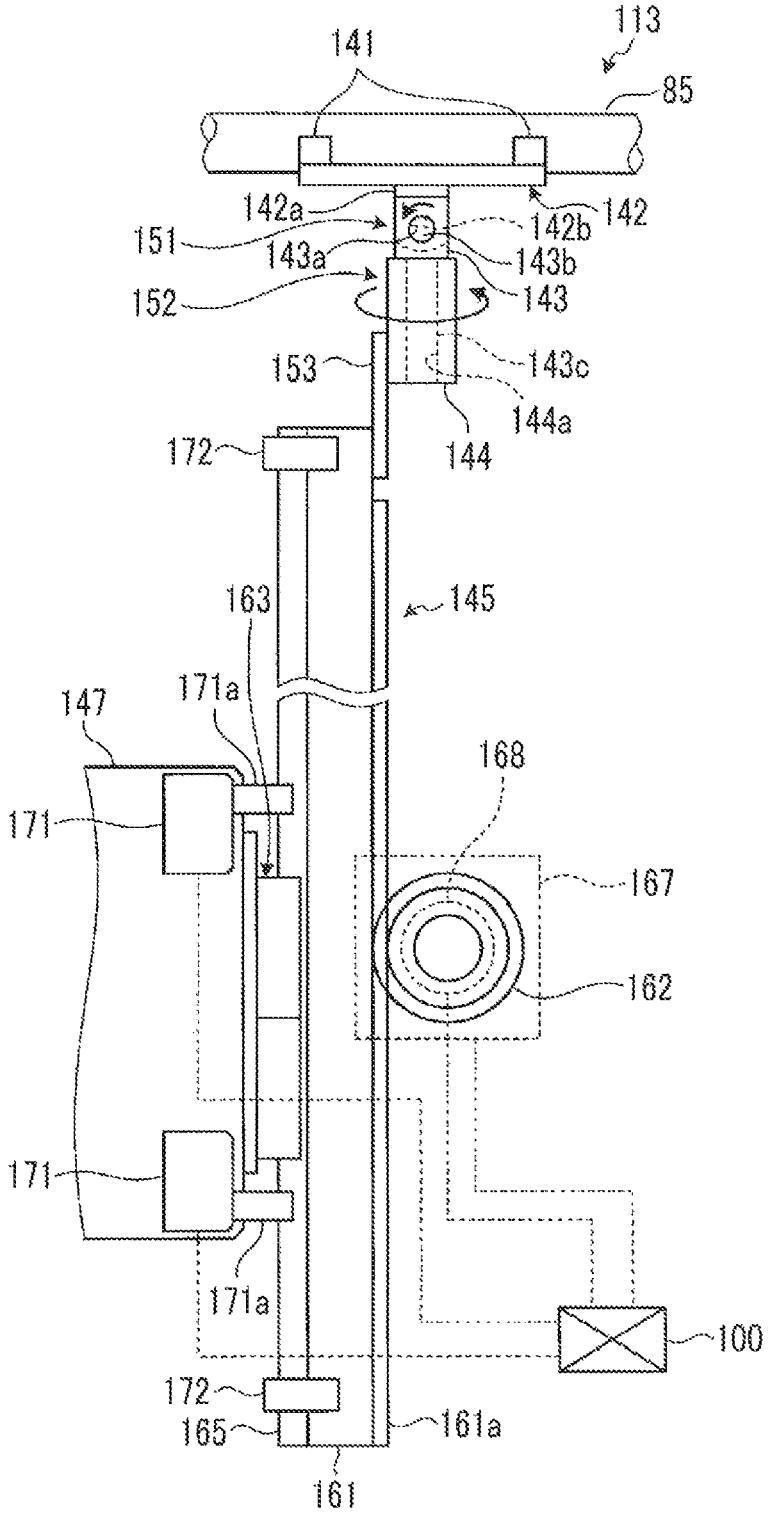
FIG. 7 is a schematic configuration diagram that illustrates a part of a central gripping moving mechanism.
Figure 8:
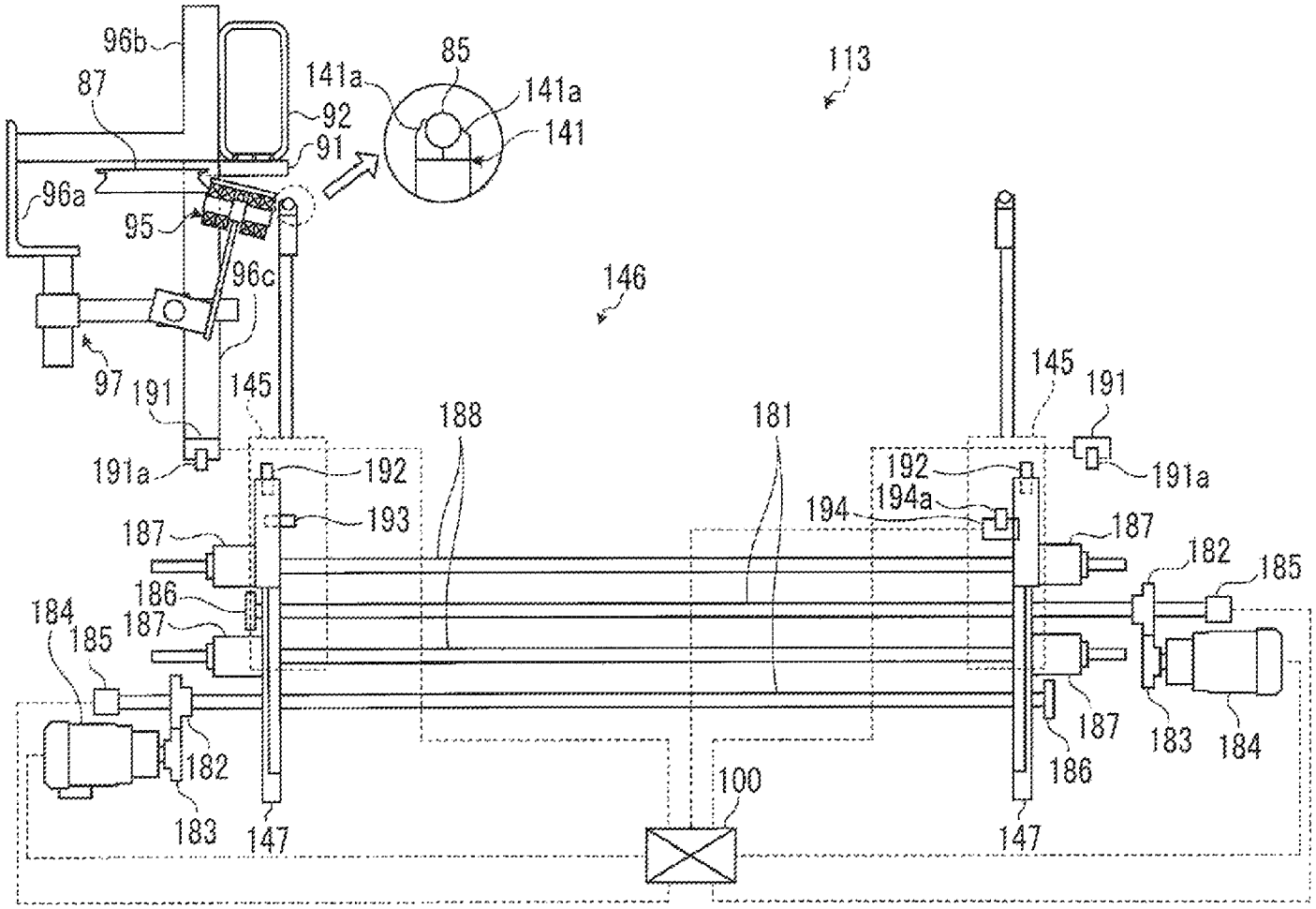
FIG. 8 is a schematic configuration diagram that illustrates another part of the central gripping moving mechanism.

FIG. 7 is a schematic configuration diagram that illustrates a part of the central gripping moving mechanism, and FIG. 8 is a schematic configuration diagram that illustrates another part of the central gripping moving mechanism. The central gripping moving mechanism 113 grips the folding bar 85 between the inlet side support mechanism 111 and the outlet side support mechanism 112 to move the folding bar 85 in the width direction and the vertical direction. The central gripping moving mechanism 113 has a pair of gripping portions 141, a connection bar (connection member) 142, a first pivoting member 143, a second pivoting member 144, a vertical direction moving mechanism 145, and a width direction moving mechanism 146.

The pair of gripping portions 141 are arranged at a predetermined interval in the axial direction of the folding bar 85. As illustrated in FIG. 8, each of the gripping portions 141 has a pair of claw portions 141*a*, and grips the folding bar 85 to regulate the movement of the folding bar 85 in the axial direction and the radiation direction by pinching the folding bar 85 with the pair of claw portions 141*a*. One of the pair of claw portions 141*a* is disposed on an inner side in the width direction, and the other one of the pair of claw portions 141*a* is disposed on an outer side in the width direction. In this case, a tip end portion of the claw portion 141*a* on the inner side in the width direction in the vertical direction is formed to be shorter than a tip end portion of the claw portion 141*a* on the outer side in the width direction in the vertical direction. In other words, the length of the claw portion 141*a* on the inner side in the width direction in the vertical direction is shorter than that of the tip end portion of the claw portion 141*a* on the outer side in the width direction in the vertical direction. In this manner, the pair of gripping portions 141 can suppress interference with the first panel S1 and the fourth panel S4 of the corrugated sheet S folded diagonally downward from the outer side toward the inner side in the width direction and can allow each of the folding bars 85 to abut against the first panel S1 and the fourth panel S4 of the corrugated sheet S.

As illustrated in FIG. 7, the connection bar 142 connects the pair of gripping portions 141, and is disposed in the axial direction of the folding bar 85. A protruding portion 142*a*, which protrudes to a lower side in the vertical direction, is disposed in the connection bar 142, and a pivot hole 142*b* is formed to penetrate the protruding portion 142*a* in the horizontal direction.

One side (upper side in FIG. 7) of the first pivoting member 143 in a longitudinal direction is pivotably connected to the pivot hole 142*b* of the connection bar 142, and the other side (lower side in FIG. 7) of the first pivoting member 143 in the longitudinal direction is pivotably connected to the second pivoting member 144. A pivot hole 143*a* is formed in a penetrating manner on the one side of the first pivoting member 143 in the longitudinal direction. A third pivoting mechanism 151 is configured by connecting the pivot hole 142*b* of the connection bar 142 and the pivot hole 143*a* of the first pivoting member 143 with each other by using a shaft portion 143*b*. In addition, the other end side of the first pivoting member 143 in the longitudinal direction is a pivot shaft 143*c* that is inserted into the second pivoting member 144.

The second pivoting member 144 is connected to the vertical direction moving mechanism 145 via a connection plate 153. An insertion hole 144*a*, into which the pivot shaft 143*c* of the first pivoting member 143 is inserted, is formed in the second pivoting member 144. A fourth pivoting mechanism 152 is configured by inserting the pivot shaft 143*c* of the first pivoting member 143 into the insertion hole 144*a* of the second pivoting member 144.

In the central gripping moving mechanism 113, a pivoting plane (vertical plane) of the connection bar 142 that is allowed to pivot by the third pivoting mechanism 151 and a pivoting plane (horizontal plane) of the first pivoting member 143 that is allowed to pivot by the fourth pivoting mechanism 152 are orthogonal to each other. Accordingly, the center of the folding bar 85 that is gripped by the central gripping moving mechanism 113 is gripped to be pivotable on the vertical plane and the horizontal plane.

As illustrated in FIG. 8, the vertical direction moving mechanism 145 is connected to the width direction moving mechanism 146 via a connection arm 147. In addition, the vertical direction moving mechanism 145 is configured to be a rack and pinion mechanism as illustrated in FIG. 7. In other words, the vertical direction moving mechanism 145 has a rack member 161 and a pinion gear 162, and moves the folding bar 85 in the vertical direction by moving the rack member 161 in the vertical direction by using the pinion gear 162. In addition, a linear guide 163 that guides the rack member 161 in the vertical direction is disposed in the vertical direction moving mechanism 145. The linear guide 163 is disposed at a position facing the pinion gear 162 across the rack member 161.

A longitudinal direction of the rack member 161 is the vertical direction. The second pivoting member 144 is connected to an upper side of the rack member 161 in the vertical direction via the connection plate 153. In addition, a gear surface 161*a* that is engaged with the pinion gear 162 is formed on one side (right side in FIG. 7) surface of the rack member 161. A rail 165 of the linear guide 163 is disposed on the other side (left side in FIG. 7) surface of the rack member 161

The pinion gear 162 is rotatably fixed to the connection arm 147, and is connected to a rotating shaft of a motor 167 as a driving source. A rotary encoder 168 is disposed on the rotating shaft of the motor 167. The motor 167 and the rotary encoder 168 are connected to the control device 100, and the control device 100 controls the driving of the motor 167 based on the amount of rotation of the pinion gear 162 which is detected by the rotary encoder 168.

The linear guide 163 is fixed to the connection arm 147, and guides a movement of the rack member 161 in the vertical direction along the rail 165 which is disposed in the rack member 161.

Accordingly, when the pinion gear 162 is rotated by the motor 167 as the driving source, the rack member 161 is moved upward and downward in the vertical direction with respect to the connection arm 147 while being guided by the linear guide 163.

In addition, a pair of upper and lower limit switches 171 are disposed in the connection arm 147, and a pair of upper and lower strikers 172 are disposed in the rack member 161. The limit switch 171 has a switch end 171*a* that protrudes toward the rack member 161. The upper side striker 172 that is in contact with the switch end 171*a* of the upper side limit switch 171 is disposed in an upper end portion of the rack member 161, and the lower side striker 172 that is in contact with the switch end 171*a* of the lower side limit switch 171 is disposed in a lower end portion of the rack member 161. The pair of upper and lower limit switches 171 are connected to the control device 100. The control device 100 detects an original point of the folding bar 85, which is connected to the rack member 161, in the vertical direction based on the detection of the pair of limit switches 171.

Accordingly, in the vertical direction moving mechanism 145, the control device 100 detects the original point of the folding bar 85 in the vertical direction by using the pair of upper and lower limit switches 171 and derives the amount of movement of the folding bar 85 in the vertical direction from the amount of rotation of the rotary encoder 168, and thus can acquire the position of the folding bar 85 in the vertical direction.

As illustrated in FIG. 2, the width direction moving mechanism 146 is connected to a device frame 149. In addition, the width direction moving mechanism 146 is configured as a mechanism in which a screw shaft 181 is used as illustrated in FIG. 8. The width direction moving mechanism 146 is configured to be capable of moving the pair of connection arms 147, to which the pair of vertical direction moving mechanisms 145 are connected, in the width direction. In other words, the one width direction moving mechanism 146 is disposed with respect to every one of the folding bars 85.

The width direction moving mechanism 146 has a pair of the screw shafts 181, and a pair of ball screws (not illustrated) that move while rotating on the respective screw shafts 181. One of the pair of ball screws connects one of the screw shafts 181 and the connection arm 147 on one side with each other. Accordingly, one of the vertical direction moving mechanisms 145 is connected to the one screw shaft 181 via the one ball screw and the one connection arm 147. The other one of the pair of ball screws connects the other screw shaft 181 and the connection arm 147 on the other side with each other. Accordingly, the other vertical direction moving mechanism 145 is connected to the other screw shaft 181 via the other ball screw and the other connection arm 147.

Specifically, the pair of screw shafts 181 are disposed side by side, in parallel with each other, upward and downward in the vertical direction, and are disposed such that an axial direction thereof extends in the horizontal direction. Of the pair of screw shafts 181, the upper side screw shaft 181 is the screw shaft 181 that moves the connection arm 147 on the one side (left side in FIG. 8) and the lower side screw shaft 181 is the screw shaft 181 that moves the connection arm 147 on the other side (right side in FIG. 8).

Each of the screw shafts 181 are axially supported by the device frame 149 to be rotatable with a stopper 186, which regulates a deviation of the ball screw, disposed in one end portion thereof and a first connection gear 182, which rotates the screw shaft 181 disposed in the other end portion thereof. A second connection gear 183 is connected to the first connection gear 182, and the second connection gear 183 is connected to a rotating shaft of a motor 184. In addition, a rotary encoder 185 is disposed on a shaft of the first connection gear 182. The motor 184 and the rotary encoder 185 are connected to the control device 100, and the control device 100 controls the driving of the motor 184 based on the amount of rotation of the screw shaft 181 which is detected by the rotary encoder 185.

A pair of rails 188, through which a linear guide 187 travels, are disposed between the pair of upper and lower screw shafts 181 and above the upper side screw shaft 181. The pair of rails 188 are disposed side by side, in parallel with each other, upward and downward in the vertical direction, and are disposed such that an axial direction thereof extends in the horizontal direction. A pair of the upper and lower linear guides 187, which guide the connection arm 147 on the one side (left side in FIG. 8), are disposed on the pair of rails 188, and the pair of upper and lower linear guides 187 are arranged close to one side of the pair of rails 188. In addition, a pair of the upper and lower linear guides 187, which guide the connection arm 147 on the other side (right side in FIG. 8) are disposed on the pair of rails 188, and the pair of upper and lower linear guides 187 are arranged close to the other side of the pair of rails 188.

Accordingly, when each of the screw shafts 181 is rotated by the motor 184 as a driving source, the connection arm 147 that is connected to each of the ball screws mounted on each of the screw shafts 181 is moved in the width direction with respect to the device frame 149 while being guided by the linear guide 187.

In addition, the two limit switches 191 that are arranged side by side in the width direction are disposed in the device frame 96*c* described above, and strikers 192 are disposed in the respective connection arms 147. The two limit switches 191 are disposed on both outer sides of the pair of connection arms 147. In addition, a striker 193 is disposed on an inner side of the one connection arm 147 in the width direction, and a limit switch 194 is disposed on an inner side of the other connection arm 147 in the width direction.

Each of the limit switches 191 has a switch end 191*a* that protrudes toward the connection arm 147 side. The striker 192 that is in contact with the switch end 191*a* of the upper side limit switch 191 is disposed on an upper side of the connection arm 147. In addition, the limit switch 194 has a switch end 194*a* that protrudes to an upper side in the vertical direction. The striker 193 that is in contact with the switch end 194*a* of the limit switch 194 on the inner side of the other connection arm 147 is disposed on the inner side of the one connection arm 147.

The pair of strikers 192 that are disposed in the pair of connection arms 147 are respectively arranged between the pair of limit switches 191. Accordingly, one of the strikers 192 that is disposed in the one connection arm 147 is in contact with the one limit switch 191, and the other striker 192 that is disposed in the other connection arm 147 is in contact with the other limit switch 191. In addition, the striker 193 that is disposed on the inner side of the one connection arm 147 in the width direction is in contact with the limit switch 194 that is disposed on the inner side of the other connection arm 147 in the width direction. The pair of limit switches 191 and the limit switch 194 are connected to the control device 100, and the control device 100 detects the original point of the pair of connection arms 147 in the width direction based on the detection of the pair of limit switches 191 and the limit switch 194.

Accordingly, in the width direction moving mechanism 146, the control device 100 detects the original point of the pair of folding bars 85 in the width direction by using the pair of limit switches 191 and the limit switch 194 and derives the amount of movement of the respective folding bars 85 in the width direction from the amount of rotation of the respective rotary encoders 185, and thus can acquire the position of the pair of folding bars 85 in the width direction. The pair of limit switches 191 described above are respectively mounted on the device frame 96*c*. The pair of limit switches 191 are moved in response to a movement of the device frame 96*c* in the width direction.

Next, the control device 100 will be described. The control device 100 adjusts the position of the pair of folding bars 85 in the vertical direction and the width direction by controlling the pair of vertical direction moving mechanisms 145 and the width direction moving mechanism 146. Herein, the control device 100 adjusts the position of the folding bar 85 according to the types of the corrugated sheets S. In other words, the first panel and the second panel of the folded corrugated sheet S have different sizes or the margin piece 334 is on the outer side to stick out depending on the types of the corrugated cardboard boxes B. In this case, the pair of folding bars 85 are guided such that both of the end portions of the corrugated sheet S in the width direction perform a predetermined folding operation.

Specifically, the control device 100 adjusts the position of the pair of folding bars 85 such that the first panel is folded first and then the fourth panel is folded when the first panel of the corrugated sheet S that is supplied to the folder/gluer unit 61 is longer in the width direction than the second panel (fourth panel) and the margin piece 334 is on the inner side to stick in. In addition, the control device 100 adjusts the position of the pair of folding bars 85 such that the fourth panel is folded first and then the first panel is folded when the first panel of the corrugated sheet S that is supplied to the folder/gluer unit 61 is longer in the width direction than the second panel (fourth panel) and the margin piece 334 is on the outer side to stick out. In addition, the control device 100 adjusts the position of the pair of folding bars 85 such that the first panel is folded first and then the fourth panel is folded when the first panel of the corrugated sheet S that is supplied to the folder/gluer unit 61 is shorter in the width direction than the second panel (fourth panel) and the margin piece 334 is on the inner side to stick in. In addition, the control device 100 adjusts the position of the pair of folding bars 85 such that the fourth panel is folded first and then the first panel is folded when the first panel of the corrugated sheet S that is supplied to the folder/gluer unit 61 is shorter in the width direction than the second panel (fourth panel) and the margin piece 334 is on the outer side to stick out.

Accordingly, when the predetermined corrugated sheet S is supplied to the folder/gluer unit 61 that has the above-described configuration, the corrugated sheet S is transferred to the outlet side in the direction D of transfer by the upper transfer belt 81 and the lower transfer belt 82. When the corrugated sheet S that is transferred to the outlet side in the direction D of transfer passes between the upper transfer belt 81 and the folding claws 83, the first panel and the fourth panel of the corrugated sheet S are folded from the pair of folding claws 83, which abut against the ruled line 322 and the ruled line 324, as the base points. Then, the pair of forming belts 84 and the pair of folding bars 85 abut against the first panel and the fourth panel of the corrugated sheet S, where the first panel and the fourth panel are folded, and the plurality of gauge rollers 87 abut against both of the end sides of the folded corrugated sheet S in the width direction. Then, the corrugated sheet S is transferred to the outlet side in the direction D of transfer by the plurality of forming belts 84 and the plurality of gauge rollers 87 such that both of the end portions of the corrugated sheet S in the width direction are further folded by the pair of folding bars 85 while being guided to perform the predetermined folding operation. Then, the first panel and the fourth panel of the corrugated sheet S are pressed, brought into close contact with each other, and bonded by the upper transfer belt 81 and the pair of forming belts 84. Then, the bonded corrugated sheet S is transferred to the counter ejector portion 71.

As described above, the position of the folding bar 85 can be automatically adjusted by controlling the moving mechanism 86 with the control device 100 according to the configuration of this embodiment. Accordingly, a mounting operation for mounting the folding bar 85 does not have to be performed, and the operation time can be shortened. In addition, the operation of the carton former 1 does not have to be stopped in adjusting the position of the folding bar 85 even in a case where the position of the folding bar 85 is finely adjusted. In other words, even in a case where the position of the folding bar 85 has to be finely adjusted, the position of the folding bar 85 can be finely adjusted, without stopping the operation of the carton former 1, while checking the folding of the corrugated sheet S. As such, the operation time can be shortened.

In addition, according to the configuration of this embodiment, the position of the folding bar 85 can be adjusted by moving the center of the folding bar 85 in the direction of transfer in the width direction and the vertical direction in a state where both of the end sides of the folding bar 85 in the direction D of transfer are supported. Accordingly, the position of the folding bar 85 can be adjusted when the central gripping moving mechanism 113 is disposed at the center of the folding bar 85 in the direction of transfer. As such, the configuration of the folder/gluer unit 61 can be simplified.

In addition, according to the configuration of this embodiment, the folding bar 85 can be allowed to pivot in the horizontal plane and the vertical plane by the inlet side support mechanism 111. As such, the inlet side support mechanism 111 can allow the inlet side end portion of the folding bar 85 in the direction of transfer to appropriately follow the movement of the center of the folding bar 85 by the central gripping moving mechanism 113.

In addition, according to the configuration of this embodiment, the first pivoting mechanism 124 and the second pivoting mechanism 125 of the inlet side support mechanism 111 can be configured by using the collars 126 and 127, and thus can be simplified and less expensive.

In addition, according to the configuration of this embodiment, the center of the folding bar 85 can be allowed to pivot in the horizontal plane and the vertical plane by the central gripping moving mechanism 113. Accordingly, the central gripping moving mechanism 113 can allow the center of the folding bar to appropriately follow the movement in the vertical direction and the width direction.

In addition, according to the configuration of this embodiment, the pair of gripping portions 141 are disposed in the axial direction of the folding bar 85, and thus the folding bar 85 can be gripped at two points. Accordingly, the pair of gripping portions 141 can allow the folding bar 85 to be more smoothly curved, during the movement of the folding bar 85, than in a case where the folding bar 85 is gripped at a single point, and thus the folding surfaces (the first panel S1 and the fourth panel S4) of the corrugated sheet S can be guided appropriately.

In addition, according to the configuration of this embodiment, the inner side of the folding bar 85 in the width direction, which is likely to be interfered with by the corrugated sheet S, can be exposed in the gripping portions 141 of the central gripping moving mechanism 113 by shortening the one claw portion 141*a* on the inner side in the width direction. Accordingly, the corrugated sheet S is unlikely to interfere with the folding bar 85, and the gripping portion 141 can allow the corrugated sheet S to appropriately abut against the folding bar 85.

In addition, according to the configuration of this embodiment, the upper side of the outlet side end portion of the folding bar 85 in the vertical direction can be exposed in the outlet side support mechanism 112 by the gripping claws 131. Accordingly, the corrugated sheet S that passes above the folding bar 85 on the outlet side in the direction D of transfer is unlikely to interfere with the folding bar 85, and the folding bar 85 can allow the corrugated sheet S to abut and be guided appropriately.

In addition, according to the configuration of this embodiment, the control device 100 can detect the original point of the folding bar 85 in the vertical direction based on a detection result of the pair of upper and lower limit switches 171 which are disposed in the vertical direction. Accordingly, the control device 100 can perform the movement control with high precision by performing the movement control in the vertical direction on the folding bar 85 based on the original point.

In addition, according to the configuration of this embodiment, the control device 100 can accurately grasp the amount of movement of the folding bar 85 in the vertical direction based on a detection result of the rotary encoder 168 which detects the amount of rotation of the motor 167. Accordingly, the control device 100 can perform the movement control in the vertical direction on the folding bar 85 with even higher precision.

In addition, according to the configuration of this embodiment, the control device 100 can detect the original point of the pair of folding bars 85 in the width direction based on a detection result of the pair of limit switches 191 and the limit switch 194 which are disposed in the width direction.

Accordingly, the control device 100 can perform the movement control with high precision by performing the movement control in the width direction on the folding bar 85 based on the original point. In addition, the original point of the pair of the folding bar 85 in the width direction can be detected by the three limit switches 191 and the limit switch 194, without the pair of limit switches 191 being disposed with respect to each of the folding bars 85, and thus the configuration can be simplified.

In addition, according to the configuration of this embodiment, the control device 100 can accurately grasp the amount of movement of the pair of folding bars 85 in the width direction based on a detection result of the pair of rotary encoders 185 which detect the amount of rotation of a pair of the motors 184. Accordingly, the control device 100 can perform the movement control in the width direction on the pair of folding bars 85 with even higher precision.

In addition, according to the configuration of this embodiment, the inlet side support mechanism 111 and the outlet side support mechanism 112 support the folding bar 85 to be movable in the axial direction and the central gripping moving mechanism 113 can grip the folding bar 85 by regulating the movement of the folding bar 85 in the axial direction. Accordingly, the inlet side end portion and the outlet side end portion of the folding bar 85 in the direction D of transfer can be moved in the axial direction in response to the movement of the center of the folding bar 85 by the central gripping moving mechanism 113. In this manner, the inlet side end portion and the outlet side end portion of the folding bar 85 in the direction D of transfer can be allowed to appropriately follow the movement of the center of the folding bar 85 in the axial direction.

REFERENCE SIGNS LIST

1 Carton former
11 Paper feed unit
21 Printing unit
31 Paper discharge unit
41 Die cut unit
51 Defective product removing unit
61 Folder/gluer unit
71 Counter ejector portion
81 Upper transfer belt
82 Lower transfer belt
83 Folding claw
84 Forming belt
85 Folding bar
86 Moving mechanism
87 Gauge roller
91 Adsorption belt
92 Ejector chamber
96*a* Device frame
100 Control device
111 Inlet side support mechanism
112 Outlet side support mechanism
113 Central gripping moving mechanism
121 Gripping member
122 Pivot shaft
123 Supporting shaft
124 First pivoting mechanism
125 Second pivoting mechanism
126 First collar
127 Second collar
131 Gripping claw
141 Gripping portion
142 Connection bar
143 First pivoting member
144 Second pivoting member
145 Vertical direction moving mechanism
146 Width direction moving mechanism
147 Connection arm
149 Device frame
151 Third pivoting mechanism
152 Fourth pivoting mechanism
153 Connection plate
161 Rack member
162 Pinion gear
163 Linear guide
165 Rail
167 Motor
168 Rotary encoder
171 Limit switch
172 Striker
181 Screw shaft
182 First connection gear
183 Second connection gear
184 Motor
185 Rotary encoder
186 Stopper
187 Linear guide
188 Rail
191 Limit switch
192 Striker
193 Striker
194 Limit switch
301 Front liner
302 Back liner
303 Corrugating medium
334 Margin piece
S Corrugated sheet

The invention claimed is:

1. A sheet folding device comprising:

a conveyance belt that conveys a conveyance sheet in a direction of conveyance;

a forming belt that abuts against a folding surface which is formed by folding both end portions of the conveyance sheet in a width direction orthogonal to the direction of conveyance and folds both of the end portions of the conveyance sheet in the width direction;

a folding bar that is disposed in the direction of conveyance, abuts against the folding surface at both of the end portions of the folded conveyance sheet in the width direction, and guides both of the end portions of the conveyance sheet in the width direction;

a moving mechanism that moves the folding bar in the width direction and in a vertical direction; and a control unit that controls the moving mechanism to adjust a position of the folding bar, wherein the moving mechanism includes an upstream side support mechanism that supports an upstream side of the folding bar in the direction of conveyance, a downstream side support mechanism that supports a downstream side of the folding bar in the direction of conveyance, and a central gripping moving mechanism that grips the folding bar between the upstream side support mechanism and the downstream side support mechanism to move the folding bar in the width direction and in the vertical direction, and the central gripping moving mechanism has a plurality of pivoting mechanisms and supports a central portion of the folding bar to be pivotable by the plurality of pivoting mechanisms.

2. The sheet folding device according to claim 1,
wherein the upstream side support mechanism has a plurality of pivoting mechanisms, and supports an upstream side end portion of the folding bar to be pivotable by the plurality of pivoting mechanisms.

3. The sheet folding device according to claim 2,
wherein the plurality of pivoting mechanisms have a first pivoting mechanism that supports the upstream side end portion of the folding bar to be pivotable in a predetermined plane.

4. The sheet folding device according to claim 3,
wherein the plurality of pivoting mechanisms have a second pivoting mechanism that supports the upstream side end portion of the folding bar to be pivotable in an orthogonal plane which is orthogonal into the predetermined plane.

5. The sheet folding device according to claim 4,
wherein the upstream side support mechanism has:
a gripping member that grips the upstream side end portion of the folding bar;
the first pivoting mechanism that pivotably supports the gripping member;
a pivot shaft where the first pivoting mechanism is disposed;
the second pivoting mechanism that pivotably supports the pivot shaft; and
a supporting shaft that is mounted on a device frame where the second pivoting mechanism is disposed.

6. The sheet folding device according to claim 5,
wherein the first pivoting mechanism is a pair of first collars that are mounted on the pivot shaft, and
wherein the gripping member is disposed between the pair of first collars, and is axially supported to be pivotable by the pivot shaft in a state where a position of the gripping member is regulated in an axial direction of the pivot shaft by the pair of first collars.

7. The sheet folding device according to claim 5,
wherein the second pivoting mechanism is a pair of second collars that are mounted on the supporting shaft, and
wherein the pivot shaft is disposed between the pair of second collars, and is axially supported to be pivotable by the supporting shaft in a state where a position of the pivot shaft is regulated in the axial direction of the supporting shaft by the pair of second collars.

8. The sheet folding device according to claim 1,
wherein the plurality of pivoting mechanisms have a third pivoting mechanism that supports the central portion of the folding bar to be pivotable in a predetermined plane.

9. The sheet folding device according to claim 8,
wherein the plurality of pivoting mechanisms have a fourth pivoting mechanism that supports the central portion of the folding bar to be pivotable in an orthogonal plane which is orthogonal into the predetermined plane.

10. The sheet folding device according to claim 9,
wherein the central gripping moving mechanism has:
a gripping portion that is disposed in the folding bar;
a connection member that is connected to the gripping portion;
a third pivoting mechanism that pivotably supports the connection member;
a first pivoting member where the third pivoting mechanism is disposed;
a fourth pivoting mechanism that pivotably supports the first pivoting member;
a second pivoting member where the fourth pivoting mechanism is disposed;
a vertical direction moving mechanism that moves the second pivoting member in the vertical direction; and
a width direction moving mechanism that moves the vertical direction moving mechanism in the width direction.

11. The sheet folding device according to claim 10,
wherein a plurality of the gripping portions are disposed in the axial direction of the folding bar, and
wherein the connection member connects the plurality of gripping portions.

12. The sheet folding device according to claim 10,
wherein the gripping portion has a pair of claw portions that pinch the folding bar from both outer sides in a radial direction,
wherein one of the pair of claw portions is disposed on an inner side in the width direction and the other one of the pair of claw portions is disposed on an outer side in the width direction, and
wherein a length of the one claw portion on the inner side in the width direction is shorter than a length of the other claw portion on the outer side in the width direction.

13. The sheet folding device according to claim 10,
wherein the vertical direction moving mechanism has a pair of upper and lower limit switches that are disposed in the vertical direction, and
wherein the control unit detects an original point of the folding bar in the vertical direction based on a detection result of each of the limit switches.

14. The sheet folding device according to claim 10,
wherein the vertical direction moving mechanism further has a motor as a driving source that moves the folding bar in the vertical direction, and a rotary encoder that detects an amount of rotation of the motor; and
wherein the control unit derives an amount of movement in the vertical direction from the amount of rotation that is detected by the rotary encoder, and acquires a position of the folding bar in the vertical direction.

15. The sheet folding device according to claim 10,
wherein a pair of the folding bars are disposed,
wherein the width direction moving mechanism has three limit switches that are disposed in the width direction, and
wherein the control unit detects an original point of each of the pair of folding bars in the width direction based on a detection result of each of the limit switches.

16. The sheet folding device according to claim 15,
wherein a pair of the vertical direction moving mechanisms are disposed to correspond to the pair of folding bars,
wherein the central gripping moving mechanism further has a pair of connection arms that connect the pair of vertical direction moving mechanisms to the width direction moving mechanism, and
wherein a pair of the three limit switches are disposed on both outer sides of the pair of connection arms in the width direction and one of the one limit switches is mounted on an inner side of one of the connection arms.

17. The sheet folding device according to claim 15,
wherein the width direction moving mechanism further has a pair of motors as a driving source that move the pair of folding bars in the width direction, and a pair of rotary encoders that detect amounts of rotation of the respective motors, and wherein the control unit derives an amount of movement in the width direction from the amounts of rotation that are detected by the pair of rotary encoders, and acquires respective positions of the pair of folding bars in the width direction.

18. The sheet folding device according to claim 1, wherein the downstream side support mechanism has a gripping claw that grips a downstream side end portion of the folding bar, and wherein the gripping claw exposes and grips an upper side of the folding bar in the vertical direction.

19. The sheet folding device according to claim 1, wherein the upstream side support mechanism and the downstream side support mechanism support the folding bar to be movable in the axial direction, and wherein the central gripping moving mechanism grips the folding bar by regulating a movement of the folding bar in the axial direction.

20. A carton former comprising:

a paper feed unit that supplies a conveyance sheet;

a printing unit that performs printing on the conveyance sheet;

a paper discharge unit that performs ruled line processing and grooving on a front surface of the conveyance sheet;

the sheet folding device according to claim 1 that forms a box by folding both of the end portions of the conveyance sheet in the width direction and bonding both of the end portions of the conveyance sheet in the width direction; and a counter ejector portion that discharges a predetermined number of the boxes after stacking the boxes while counting the boxes.

* * * * *